US006698110B1

(12) United States Patent
Robbins

(10) Patent No.: US 6,698,110 B1
(45) Date of Patent: Mar. 2, 2004

(54) SPIKED SHOE HAVING A SPIKE CLEANING CUSHION

(76) Inventor: Timothy A. Robbins, 2575 Airport Lake Rd., McMinnville, TN (US) 37110

( * ) Notice: Subject to any disclaimer, the term of this patent is extended or adjusted under 35 U.S.C. 154(b) by 0 days.

(21) Appl. No.: 10/280,659

(22) Filed: Oct. 28, 2002

(51) Int. Cl.[7] ..... A43B 15/00; A43B 5/00
(52) U.S. Cl. ..... 36/61; 36/59 R; 36/134
(58) Field of Search ..... 36/61, 59 R, 127, 36/134, 7.6, 7.7, 67 R

(56) References Cited

U.S. PATENT DOCUMENTS

| | | | | | |
|---|---|---|---|---|---|
| 303,287 | A | * | 8/1884 | Hunn | 36/59 R |
| 3,324,578 | A | * | 6/1967 | Brutting | 36/129 |
| 3,351,353 | A | | 11/1967 | Weitzner | |
| 3,747,238 | A | * | 7/1973 | Jankauskas | 36/61 |
| 3,906,646 | A | | 9/1975 | Milotic | |
| 4,146,979 | A | * | 4/1979 | Fabbrie | 36/67 D |
| 4,271,608 | A | * | 6/1981 | Tomuro | 36/61 |
| 4,466,205 | A | * | 8/1984 | Corbari | 36/134 |
| 4,484,398 | A | | 11/1984 | Goodwin et al. | |
| 4,715,133 | A | * | 12/1987 | Hartjes et al. | 36/127 |
| 5,070,631 | A | | 12/1991 | Fenton | |
| 5,083,385 | A | | 1/1992 | Halford | |
| 5,410,821 | A | | 5/1995 | Hilgendorf | |
| 5,548,910 | A | | 8/1996 | Klingseis | |
| 5,661,915 | A | | 9/1997 | Smith | |
| 6,032,386 | A | | 3/2000 | Evans | |

* cited by examiner

*Primary Examiner*—M. D. Patterson
(74) *Attorney, Agent, or Firm*—Donald R. Schoonover

(57) ABSTRACT

A spike shoe has a cushion mounted on the outer sole thereof. The cushion has spike-accommodating bores defined therein and each spike is accommodated in a bore. The cushion compresses as the wearer of the shoe places his or her weight on the sole of the shoe. The spike-accommodating bores are sized and shaped so the cushion adjacent to each bore contacts the spike accommodated in the bore during the compression of the cushion and prior to the cushion being fully compressed whereby each spike is wiped by the cushion every time the wearer places his or her weight on the shoe during a walking or running movement.

3 Claims, 1 Drawing Sheet

SPIKED SHOE HAVING A SPIKE CLEANING CUSHION

BACKGROUND OF THE INVENTION

1. Field of the Invention

The present invention relates to the general art of wearing apparel, and to the particular field of shoes and accessories therefor.

2. Discussion of the Related Art

Many activities require a participant to run, stop and turn, often quickly. Good traction is therefore a requirement for such activities. Therefore, many sport shoes have outer soles that are specially designed to create traction. Games, such as basketball, volleyball and the like have such specially designed shoes.

Still other such games are conducted out of doors on playing fields, or even indoors on special playing courts. Football, golf, soccer and baseball are merely examples of such games that are played out of doors or on grass-type playing fields. Therefore, these games, also, have shoes that have specially designed outer soles.

Often, the outdoor games use shoes with spikes. While spikes greatly increase traction, spikes have drawbacks. If the playing field is muddy, mud tends to stick to the spikes. This vitiates the advantages associated with spikes. Not only does this require a participant to stop the activity to clean mud from the spikes, it may be dangerous. A participant may count on a particular traction from the spikes and if that traction is not present, the person can fall or twist a knee.

Therefore, there is a need for a spiked shoe that retains its ability to create traction. Still further, there is a need for a spiked shoe that retains its ability to create traction even when the ground is muddy or would otherwise tend to stick to the spikes thereby vitiating the traction features associated with spikes.

While there are tools available for cleaning spikes, such tools require the user to stop the activity to clean the spikes. Until the mud is cleaned from the spikes, the above-mentioned problems and drawbacks will be present. It is not always possible or convenient for a participant to stop the activity to clean spikes.

Therefore, there is a need for a spiked shoe that retains its ability to create traction and in which the spikes are continuously cleaned.

PRINCIPAL OBJECTS OF THE INVENTION

It is a main object of the present invention to provide a spiked shoe that retains its ability to create traction.

It is another object of the present invention to provide a spiked shoe that retains its ability to create traction even when the ground is muddy or would otherwise tend to stick to the spikes thereby vitiating the traction features associated with spikes.

It is another object of the present invention to provide a spiked shoe in which the spikes are continuously cleaned.

SUMMARY OF THE INVENTION

These, and other, objects are achieved by a shoe unit which comprises an outer sole; a plurality of conical spikes mounted on the outer sole, each spike having a height dimension measured from the outer sole; a foam cushion mounted on the outer sole and having a first wall fixed to the outer sole, a second wall and a thickness dimension measured between the first wall and the second wall; a plurality of bores defined in the foam cushion, each bore accommodating a spike; the foam cushion being compressible between a pre-compressed condition with the thickness dimension of the foam cushion being essentially equal to the height dimension of the spikes when no compressive force is applied to the foam cushion via the outer sole, the thickness dimension of the foam cushion being less than the height dimension of the spikes when compressive force is applied to the foam cushion via the outer sole. The bores defined in the foam cushion being sized and shaped so the foam cushion adjacent to the bores is spaced apart from the spikes when the foam cushion is in the pre-compressed condition and the bores defined in the foam cushion being further sized and shaped so the foam cushion adjacent to the bores will contact the spikes when the foam cushion is being moved into the compressed condition by compressive force applied to the foam cushion via the outer sole, the foam cushion contacting the spikes prior to reaching the compressed condition.

Thus, every time a wearer steps down on the shoe, the foam cushion will compress and contact the spikes. Since the foam cushion contacts the spikes prior to reaching a fully compressed condition, the foam cushion will "wipe" the spike clean as the foam cushion moves from the pre-compressed condition to the compressed condition and back again to the pre-compressed condition. The foam cushion then returns to the pre-compressed condition when the wearer removes his weight from the foot during the walking or running process. The spikes are thus continuously cleaned thereby allowing the wearer to obtain the full benefit of the spikes at all times.

BRIEF DESCRIPTION OF THE DRAWING FIGURES

DETAILED DESCRIPTION OF THE PREFERRED EMBODIMENT

Figure 1:
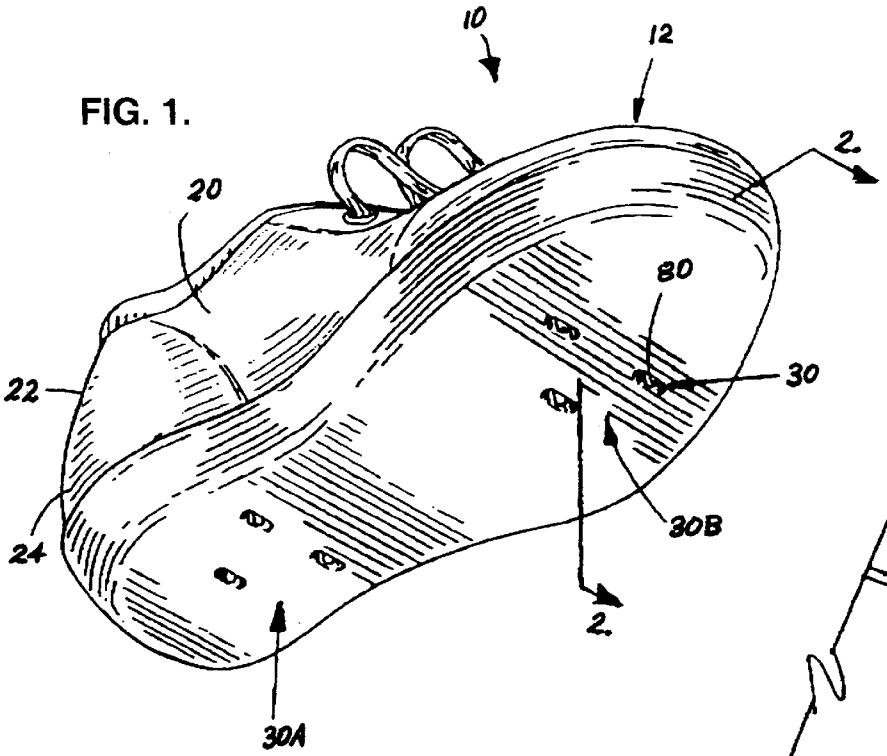
FIG. 1 is a bottom perspective view of a spiked shoe embodying the present invention.

Other objects, features and advantages of the invention will become apparent from a consideration of the following detailed description and the accompanying drawings.

As shown in the figures, the present invention is embodied in a spiked shoe 10 which is worn during walking or running and which is subject to compressive force every time a wearer places his or her weight on the shoe 10 during such walking or running. Those skilled in the art will understand this weight-generated compressive force, and thus no further description thereof will be presented. Spiked shoe 10 comprises a shoe unit 12 having an outer sole 14, a vamp 16, an inner sole 18, with a wearer's foot contacting the inner sole 18 when the shoe unit 12 is worn. Shoe unit 12 further includes sides such as side 20, a rear 22, a heel 24, and a toe box 26.

A plurality of spikes, such as spike 30, are mounted on the outer sole 14. Each spike 30 is spaced apart from adjacent spikes 30, and the plurality of spikes 30 include a first group 30A of spikes located adjacent to the heel 24 of the shoe unit 12 and a second group 30B of spikes located adjacent to the toe box 26 of the shoe unit 12. The spikes 30 are all identical, and each spike 30 includes a mounting base 32 having a first side 34 fixed to the outer sole 14 and a second side 36. Each spike 30 further includes a conical body 38 having a base 40 on the mounting base 32, an apex 42 spaced apart from the base 40 of the spike 30, and a conical wall 44 extending from the base 40 of the spike 30 to the apex 42 of the spike 30. A base diameter 46 of each spike 30 is measured at the base 40 of the spike 30 and an apex diameter 48 is measured adjacent to the apex 48 of the spike 30. The base diameter 46 of the spike 30 is larger than the apex diameter 48 of the spike 30. A height dimension 50 is measured between the base 40 of the conical body 38 and the apex 42 of the conical body 38.

A spike cleaner unit 60 cleans the spikes 30 every time the wearer places his or her weight on the shoe unit 12. Cleaner unit 60 includes a foam cushion 62 having a first surface 64 fixed to the outer sole 14 of the shoe unit 12 and a second surface 66 spaced apart from the outer sole 14 of the shoe unit 12. A thickness dimension 68 is measured between the first surface 64 of the foam cushion 62 and the second surface 66 of the foam cushion 62. A rubber-like outer cover 70 is mounted on the second surface 66 of the foam cushion 62. A portion 72 of the outer cover 70 is fixed to the shoe unit 12 adjacent to the toe box 26 of the shoe unit 12 and adjacent to the outer sole 14 of the shoe unit 12.

Figure 2:
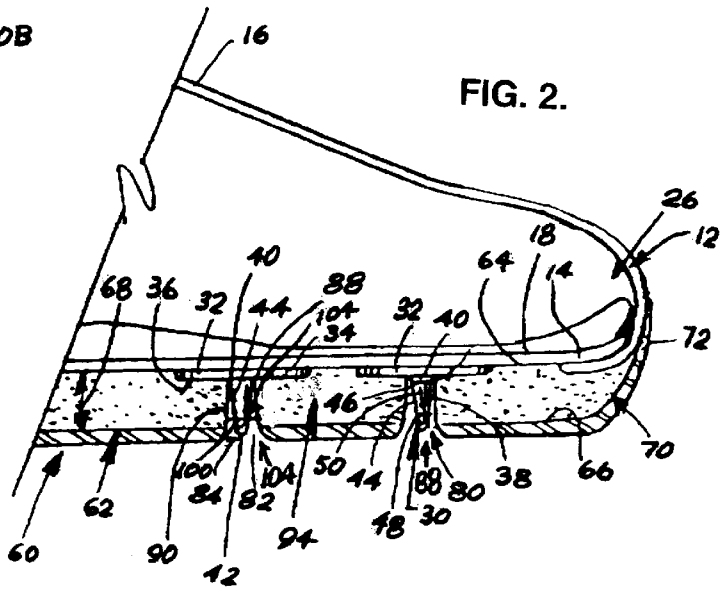
FIG. 2 is an elevational view taken along line 2—2 of FIG. 1.

A plurality of spike-accommodating frusto-conical bores, such as bore 80, are defined in the foam cushion 62 at locations to accommodate the spikes 30. The bores 80 are identical and each spike 30 being associated with one of the frusto-conical bores 80. Each bore 80 extends from the second surface 66 of the foam cushion 62 to the first surface 64 of the foam cushion 62. Each bore 80 has a truncated conical shape and includes a base 82 having a base diameter 84, a frustum 86 having a frustum diameter 88 and a frusto-conical wall 90 connecting the base 82 of the frusto-conical bore 80 to the frustum 86 of the frusto-conical bore 80. The diameter 88 of the frustum 86 is shown in FIG. 2 to be spaced apart from the frustum 86 for the sake of clarity of the Figures; however, it is to be understood that this diameter 88 is measured at the frustum 86 of the bore 80. The diameter 88 of the frustum 86 is smaller than the diameter 84 of the base 82 of the bore 80 and larger than the diameter 48 of the apex 42 of the spike 30 associated with the bore 80. The diameter 84 of the base 82 of the bore 80 is larger than the diameter 46 of the base 40 of the spike 30 associated with the bore 80. Each bore 80 further has a height dimension 92 that extends between the frustum 86 of the bore 80 and the base 82 of the bore 80.

As can be understood from the Figures, the conical bodies 38 of the spikes 30 are oriented from the base 40 of each spike 30 to the apex 42 of each spike 30 in an orientation that is opposite to the orientation of the frusto-conical bores 80 from the base 82 of each bore 80 to the frustum 86 of each bore 80.

Figure 3:
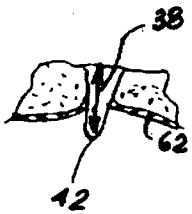
FIG. 3 is a partial view showing the arrangement of the outer sole with respect to a spike during operation of the outer sole when compressive force is applied to the outer sole by a wearer bearing on the outer sole.

The foam cushion 62 is formed of compressible material 94 and is compressible to have the second surface 66 of the foam cushion 62 moving between a pre-compressed condition shown in FIG. 2 having the second surface 66 of the foam cushion 62 spaced a pre-compressed distance from the outer sole 14 of the shoe 12 when no compressive force is applied to the outer sole 14 of the shoe 12 and to the second surface 66 of the foam cushion 62 and a compressed condition shown in FIG. 3 having the second surface 66 of the foam cushion 62 a compressed distance from the outer sole 14 of the shoe 12 when compressive force is applied to the outer sole 14 of the shoe 12 and to the second surface 66 of the foam cushion 62. By comparing FIGS. 2 and 3, it can be understood that the pre-compressed distance is larger than the compressed distance and the pre-compressed distance is essentially equal to the height dimension 50 of a spike 30. As can also be understood from FIGS. 2 and 3, the thickness dimension 68 of the foam cushion 62 changes from a pre-compressed thickness to a compressed thickness with the pre-compressed thickness of the foam cushion 62 being essentially equal to the height dimension 50 of each of the spikes 30.

Each bore 80 of the foam cushion 62 has a unit diameter 100 measured across the frusto-conical wall 90 of the frusto-conical bore 80 at a location of the bore 80 between the base 82 of the frusto-conical bore 80 and the frustum 86 of the frusto-conical bore 80. Each spike 30 has a unit diameter 102 measured across the conical wall 44 of the spike 30 at a location on the spike 30 between the base 40 of the spike 30 and the apex 42 of the spike 30. A unit diameter 100 at any location of the frusto-conical bore 80 changes and decreases as the foam cushion 62 is compressed from the pre-compressed condition to the compressed condition. The unit diameter of a frusto-conical bore 80 of the foam cushion 62 at any chosen location of the frusto-conical bore 80 is larger than the unit diameter of the spike 30 associated therewith at a location on the spike 30 corresponding to the chosen location of the frusto-conical bore 80 when the foam cushion 62 is in the pre-compressed condition. As can be understood from FIG. 4, the unit diameter of the frusto-conical bore 80 of the foam cushion 62 at the chosen location is equal to the unit diameter of the spike 30 associated therewith at the location on the spike 30 corresponding to the chosen location of the frusto-conical bore 80 when the foam cushion 62 is in the compressed condition with the foam cushion 62 adjacent to the frusto-conical bore 80 at the unit diameter at the chosen location in the foam cushion 62 contacting the spike 30 associated with the frusto-conical bore 80 at the location on the spike 30 corresponding to the chosen location of the frusto-conical bore 80 when the foam cushion 62 is in the compressed condition. The foam cushion 62 adjacent to the frusto-conical bore 80 in the foam cushion 62 at the chosen location of the frusto-conical bore 80 is spaced apart from the spike 30 associated with the frusto-conical bore 80 in the foam cushion 62 at the location on the spike 30 corresponding to the chosen location of the frusto-conical bore 80 when the foam cushion 62 is in the pre-compressed condition. Thus, in the pre-compressed condition, a gap, such as gap 104, is defined between the cushion 62 adjacent to the spike-accommodating bore 80 and the spike 30, and that gap 104 disappears when the cushion 62 is forced into the compressed condition.

Figure 4:
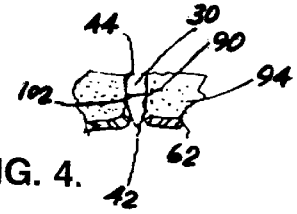
FIG. 4 is a partial view showing the arrangement of the outer sole with respect to a spike near the end of operation of the outer sole when compressive force is applied to the outer sole by a wearer bearing on the outer sole.

By comparing FIGS. 2, 3 and 4, it can be understood that the bores 80 defined in the foam cushion 62 are sized and shaped so the foam cushion 62 adjacent to the bores 80 is spaced apart from the spikes 30 when the foam cushion 62 is in the pre-compressed condition and the bores 80 defined in the foam cushion 62 are further sized and shaped so the foam cushion 62 adjacent to the bores 80 will contact the spikes 30 when the foam cushion 62 is being moved into the compressed condition by compressive force applied to the foam cushion 62 via the outer sole 14, and the foam cushion 62 contacts the spikes 30 prior to reaching the compressed condition. The foam cushion 62 also contacts the spike 30 during the return movement from the compressed condition to the pre-compressed condition. Thus, every time a wearer steps down on the shoe 12, the foam cushion 62 will compress and contact the spikes 30. Since the foam cushion 62 contacts the spikes 30 prior to reaching a fully compressed condition, the foam cushion 62 will "wipe" the spike 30 clean as the foam cushion 62 moves from the pre-compressed condition to the compressed condition. The foam cushion 62 then returns to the pre-compressed condition when the wearer removes his weight from the foot during the walking or running process and again wipes against the spike 30 until and as the cushion 62 fully returns to its pre-compressed condition thereby forcing mud, grime and grass off of the spike 30 to further clean the spike 30. In either case, the relative movement of the cushion 62 with respect to the spike 30 is towards the apex 42 of the spike 30 while in contact with the spike 30 thereby removing mud and the like from the spike 30.

It is understood that while certain forms of the present invention have been illustrated and described herein, it is not to be limited to the specific forms or arrangements of parts described and shown.

What is claimed and desired to be covered by Letters Patent is:

1. A shoe unit comprising:

a) an outer sole;

b) a plurality of conical spikes mounted on said outer sole, each spike having a height dimension measured from said outer sole;

c) a foam cushion mounted on said outer sole and having a first wall fixed to said outer sole, a second wall and a thickness dimension measured between the first wall and the second wall;

d) a plurality of bores defined in said foam cushion, each bore accommodating a spike of said plurality of spikes;

e) said foam cushion being compressible between a pre-compressed condition with the thickness dimension of said foam cushion being essentially equal to the height dimension of said spikes when no compressive force is applied to said foam cushion via said outer sole, the thickness dimension of said foam cushion being less than the height dimension of the spikes of said plurality of spikes when compressive force is applied to said foam cushion via said outer sole; and f) the bores defined in said foam cushion being sized and shaped so the foam cushion adjacent to the bores is spaced apart from-said spikes when said foam cushion is in the pre-compressed condition and the bores defined in said foam cushion being further sized and shaped so said foam cushion adjacent to the bores will contact said spikes when said foam cushion is being moved into the compressed condition by compressive force applied to said foam cushion via said outer sole, said foam cushion contacting said spikes prior to reaching the compressed condition.

2. A spiked shoe comprising:

a) a shoe unit having (1) an outer sole, (2) a vamp, (3) an inner sole, with a wearer's foot contacting the inner sole when said shoe unit is worn, (4) sides, (5) a rear, (6) a heel, and (7) a toe box;

b) a plurality of spikes mounted on the outer sole, each spike being spaced apart from adjacent spikes, said plurality of spikes including a first group of spikes located adjacent to the heel of said shoe unit and a second group of spikes located adjacent to the toe box of said shoe unit, each spike of said plurality of spikes including (1) a mounting base having a first side fixed to the outer sole and a second side, (2) a conical body having a base on the mounting base, an apex spaced apart from the base of the spike, a conical wall extending from the base of the spike to the apex of the spike, a base diameter measured at the base of the spike, and an apex diameter measured adjacent to the apex of the spike, the base diameter of the spike being larger than the apex diameter of the spike, and a height dimension measured between the base of the conical body and the apex of the conical body;

c) a spike cleaner unit which includes (1) a foam cushion having (A) a first surface fixed to the outer sole of said shoe unit and a second surface spaced apart from the outer sole of said shoe unit, and a thickness dimension measured between the first surface of the foam cushion and the second surface of the foam cushion, (B) a rubber-like outer cover on the second surface of the foam cushion, a portion of the outer cover being fixed to said shoe unit adjacent to the toe box of said shoe box and adjacent to the outer sole of said shoe box, (C) a plurality of spike-accommodating frusto-conical bores defined in the foam cushion at locations to accommodate the spikes, with each spike being associated with one of the frusto-conical bores, each bore extending from the second surface of the foam cushion to the first surface of the foam cushion, each bore having a truncated conical shape and including (I) a base having a base diameter, (ii) a frustum having a frustum diameter, (iii) a frusto-conical wall connecting the base of the frusto-conical bore to the frustum of the frusto-conical bore, the diameter of the frustum being smaller than the diameter of the base of the bore and larger than the diameter of the apex of the spike associated with the bore, the diameter of the base of the bore being larger than the diameter of the base of the spike associated with the bore, and (iv) a height dimension extending between the frustum of the bore and the base of the bore;

d) the conical bodies of the spikes of said plurality of spikes being oriented from the base of each spike to the apex of each spike in an orientation that is opposite to the orientation of the frusto-conical bores from the base of each bore to the frustum of each bore;

e) the foam cushion being formed of compressible material and being compressible to have the second surface of the foam cushion moving between a pre-compressed condition having the second surface of the foam cushion spaced a pre-compressed distance from the outer sole of the shoe when no compressive force is applied to the outer sole of the shoe and to the second surface of the foam cushion and a compressed condition having the second surface of the foam cushion a compressed distance from the outer sole of said shoe when compressive force is applied to the outer sole of the shoe and to the second surface of the foam cushion, the pre-compressed distance being larger than the compressed distance, the pre-compressed distance being essentially equal to the height dimension of a spike, and the thickness dimension of the foam cushion changing from a pre-compressed thickness to a compressed thickness, the pre-compressed thickness of the foam cushion being essentially equal to the height dimension of each of the spikes;

f) each bore of the foam cushion having a unit diameter measured across the frusto-conical wall of the frusto-conical bore at a location of the bore between the base of the frusto-conical bore and the frustum of the frusto-conical bore;

g) each spike having a unit diameter measured across the conical wall of the spike at a location on the spike between the base of the spike and the apex of the spike;

h) a unit diameter at any location of the frusto-conical bore changing and decreasing as the foam cushion is compressed from the pre-compressed condition to the compressed condition;

I) the unit diameter of a frusto-conical bore of the foam cushion at any chosen location of the frusto-conical bore being larger than the unit diameter of the spike associated therewith at a location on the spike corresponding to the chosen location of the frusto-conical bore when the foam cushion is in the pre-compressed condition; and j) the unit diameter of the frusto-conical bore of the foam cushion at the chosen location being equal to the unit diameter of the spike associated therewith at the location on the spike corresponding to the chosen location of the frusto-conical bore when the foam cushion is in the compressed condition with the foam cushion adjacent to the frusto-conical bore at the unit diameter at the chosen location in the foam cushion contacting the spike associated with the frusto-conical bore at the location on the spike corresponding to the chosen location of the frusto-conical bore when the foam cushion is in the compressed condition and the foam cushion adjacent to the frusto-conical bore in the foam cushion at the chosen location of the frusto-conical bore being spaced apart from the spike associated with the frusto-conical bore in the foam cushion at the location on the spike corresponding to the chosen location of the frusto-conical bore when the foam cushion is in the pre-compressed condition.

3. A spiked shoe comprising:

a) a shoe unit having an outer sole, a toe box, sides, and a heel;

b) a plurality of spikes mounted on the outer sole, each spike being spaced apart from adjacent spikes, said plurality of spikes including a first group of spikes located near the heel of said shoe unit and a second group of spikes located near the toe box of said shoe unit, each spike including (1) a mounting base fixed to the outer sole of said shoe unit, and (2) a conical body having a base on the mounting base, an apex spaced apart from the base of the spike, a conical wall extending from the base of the spike to the apex of the spike, a base dimension measured at the base of the spike, and an apex dimension measured adjacent to the apex of the spike, the base dimension of the spike being larger than the apex dimension of the spike; and c) a spike cleaner unit which includes (1) a foam cushion having a first surface fixed to the outer sole of said shoe unit and a second surface spaced apart from the outer sole of said shoe unit, and (2) a plurality of frusto-conical spike-accommodating bores defined in the foam cushion at locations so that each spike-accommodating bore accommodates a spike, each spike-accommodating bore extending from the second surface of the foam cushion to the first surface of the foam cushion, each spike-accommodating bore including (A) a base having a base dimension, (B) a frustum having a frustum dimension, the frustum dimension of the spike-accommodating bore being smaller than the base dimension of the spike-accommodating bore, the frustum dimension of the spike-accommodating bore being larger than the base dimension of the spike accommodated therein, (C) a wall connecting the base of the spike-accommodating bore to the frustum of the spike-accommodating bore, and (D) a height dimension extending between the base of the spike-accommodating bore and the frustum of the spike-accommodating bore;

d) the conical bodies of the spikes being oriented from the base of each spike to the apex of each spike in an orientation that is opposite to the orientation of the frusto-conical spike-accommodating bores from the base of each spike-accommodating bore to the frustum of each spike-accommodating bore;

e) the foam cushion being formed of compressible material and being compressible and having the second surface of the foam cushion moving between a pre-compressed condition having the second surface of the foam cushion spaced a pre-compressed distance from the outer sole of said shoe unit when no compressive force is applied to the foam cushion via the outer sole of said shoe unit and a compressed condition having the second surface of the foam cushion spaced a compressed distance from the outer sole of said shoe unit when compressive force is applied to the foam cushion via the outer sole of said shoe unit, the compressed distance being less than the pre-compressed distance; and f) the spike-accommodating bores defined in said foam cushion being sized and shaped so the foam cushion adjacent to the spike-accommodating bores is spaced apart from said spikes when said foam cushion is in the pre-compressed condition and the spike-accommodating bores defined in said foam cushion being further sized and shaped so said foam cushion adjacent to the spike-accommodating bores will contact said spikes when said foam cushion is being moved into the compressed condition by compressive force applied to said foam cushion via said outer sole, said foam cushion contacting said spikes prior to reaching the compressed condition.

* * * * *